US007313897B2

(12) United States Patent
Han

(10) Patent No.: US 7,313,897 B2
(45) Date of Patent: Jan. 1, 2008

(54) GARMENT BAGGING APPARATUS

(76) Inventor: Young H. Han, 6420 S. Curey Way, Aurora, CO (US) 80016

( * ) Notice: Subject to any disclaimer, the term of this patent is extended or adjusted under 35 U.S.C. 154(b) by 87 days.

(21) Appl. No.: 11/304,279

(22) Filed: Dec. 15, 2005

(65) Prior Publication Data

US 2006/0130428 A1 Jun. 22, 2006

Related U.S. Application Data

(60) Provisional application No. 60/651,468, filed on Dec. 18, 2004.

(51) Int. Cl.
*B65B 67/04* (2006.01)
*B65B 43/46* (2006.01)

(52) U.S. Cl. ..... 53/241; 53/256

(58) Field of Classification Search ..... 53/241, 53/256, 567

See application file for complete search history.

(56) References Cited

U.S. PATENT DOCUMENTS

| | | | | |
|---|---|---|---|---|
| 1,733,428 | A | 10/1929 | Ryan | |
| 1,808,824 | A | 6/1931 | Shields | |
| 1,830,368 | A | 11/1931 | McEwen | |
| 1,908,983 | A | 5/1933 | Kabat | |
| 1,984,631 | A | 12/1934 | Coss | |
| 2,057,406 | A | 10/1936 | Willson | |
| 2,132,995 | A | 10/1938 | Oliver | |
| 2,144,907 | A | 1/1939 | Allen | |
| 2,238,297 | A | 4/1941 | Timm et al. | |
| 2,284,160 | A * | 5/1942 | McCarty | 53/256 |
| 2,302,237 | A | 11/1942 | McFall | |
| 2,521,197 | A | 9/1950 | Zaloudek | |
| 2,532,232 | A | 11/1950 | Jensen | |
| 2,542,449 | A | 2/1951 | Allen | |
| 2,554,907 | A | 5/1951 | Hinnant | |
| 2,609,983 | A | 9/1952 | Denton | |
| 2,618,423 | A | 11/1952 | Blake | |
| 2,649,233 | A * | 8/1953 | Ingraham | 53/241 |
| 2,747,824 | A | 5/1956 | Darnell, Jr. | |
| 2,751,734 | A | 6/1956 | Ratliff | |
| 2,755,610 | A | 7/1956 | Johnson | |
| 2,861,408 | A | 11/1958 | Schultz | |
| 2,971,310 | A * | 2/1961 | Umbriaco | 53/256 |
| 3,025,649 | A | 3/1962 | Stuhlman | |
| 3,112,586 | A | 12/1963 | Luetzow | |
| 3,287,881 | A | 11/1966 | Jelling et al. | |

(Continued)

FOREIGN PATENT DOCUMENTS

FR 2785255 A1 5/2000

(Continued)

*Primary Examiner*—John Sipos
(74) *Attorney, Agent, or Firm*—Law Offices of Donald Cox, LLC

(57) ABSTRACT

A garment bagging apparatus having a frame connected to a feeder drive train for supporting a supply of bagging material. A garment support is positioned relative to the feeder drive train. Suspension members attached to the frame suspend the apparatus off of and in spaced apart relation to a floor surface. A feed carriage is included with support members to moveably support the feed carriage solely from a portion of the frame above the feed carriage. Grippers are mounted on the feed carriage to grip the bagging material. When a garment is hung from the garment support, the feed carriage is moveable to positions below the garment.

6 Claims, 6 Drawing Sheets

U.S. PATENT DOCUMENTS

| | | | | |
|---|---|---|---|---|
| 3,340,678 | A | | 9/1967 | Rhodes |
| 3,895,480 | A | | 7/1975 | Lombardo |
| 3,961,460 | A | | 6/1976 | Jelling et al. |
| 3,982,377 | A | | 9/1976 | Vanderpool |
| 3,987,603 | A | | 10/1976 | Jelling et al. |
| 4,018,327 | A | | 4/1977 | Goodman et al. |
| 4,082,596 | A | | 4/1978 | Vanderpool |
| 4,091,598 | A | | 5/1978 | Vulcano et al. |
| 4,094,128 | A | | 6/1978 | Vulcano et al. |
| 4,147,010 | A | | 4/1979 | Firsty |
| 4,213,284 | A | | 7/1980 | Silverman et al. |
| 4,233,797 | A | | 11/1980 | Schwarz |
| 4,253,290 | A | | 3/1981 | Vulcano et al. |
| 4,260,447 | A | | 4/1981 | Muscariello |
| 4,264,395 | A | | 4/1981 | Tota et al. |
| 4,324,087 | A | | 4/1982 | Mitchell et al. |
| 4,341,583 | A | | 7/1982 | Schwarz |
| 4,680,073 | A | | 7/1987 | Brunner et al. |
| 4,873,812 | A | | 10/1989 | Pavel |
| 5,887,310 | A | * | 3/1999 | Wright ..... 15/209.1 |
| 6,363,690 | B1 | | 4/2002 | Lay et al. |
| D469,975 | S | | 2/2003 | Sparkowski |
| 6,575,416 | B1 | * | 6/2003 | Avinger ..... 248/307 |
| 6,606,839 | B1 | | 8/2003 | Suda et al. |
| 6,726,033 | B2 | | 4/2004 | Sparkowski et al. |

FOREIGN PATENT DOCUMENTS

| | | | |
|---|---|---|---|
| GB | 842408 | A | 7/1960 |
| GB | 842827 | A | 7/1960 |
| GB | 2078656 | A | 1/1982 |

* cited by examiner

GARMENT BAGGING APPARATUS

CROSS-REFERENCE(S) TO RELATED APPLICATION(S)

This application claims the benefit of U.S. Provisional Application Ser. No. 60/651,468 filed on Dec. 18, 2004, which is incorporated herein by reference.

FIELD OF THE INVENTION

This invention relates generally to bagging machines, and, more particularly, to an improved apparatus for bagging garments.

BACKGROUND OF THE INVENTION

With the advent of professional cleaners including laundry and dry cleaning services, the need has existed for packaging cleaned and pressed garments in a manner that preserves the look of the garment until it is to be worn by the consumer. While a number of different garment packages have been developed such as boxes and paper sleeves or bags, the package material most often used today is a clear plastic sleeve or bag that covers the garment. The tube or sleeve of plastic material is generally produced as a roll of material that may be formed as one continuous tubular sheet or perforated and sealed near the perforation to provide a plurality of pre-cut garment bags.

A variety of mechanisms have been developed to place the cleaned garments in the plastic garment bags. Manual as well as automated mechanisms are known in the art for placing the garment in the plastic sleeve in a manner that preserves the pressed and clean condition of the garment. Mechanisms have also been tailored to operate with perforated or continuous sheets of plastic material. In a most basic form, the machine includes an axle for maintaining a roll of plastic, a drive train for delivering the plastic to a garment, a spreader for opening the plastic sleeve to cover the garment and a mechanism, either manual or automated, for surrounding the garment with the plastic. A frame is provided to maintain the configuration of the assembly components and support them from the floor. Additionally, continuous feed mechanisms may include a heat sealer and cutter to tailor the length of the bag cut and sealed to the size of the garment.

More recently developments in garment bagging have focused on large scale and automated operations. Such systems provide a garment bagging process without the need for human transfer of the garment from the cleaning and pressing work area to the bagging work area. Such devices, while suitable for their intended purpose in large garment cleaning operations with ample floor space, do not assist with the problems faced by many cleaning operations in which size, production volume and the maintenance cost of large scale operations are greater than facility size and manual labor costs. In these situations, such devices are not preferred. On the other hand, smaller bagging machines have not changed much in the last several years, as manufacturers have focused new systems on large-scale garment bagging devices.

One problem faced by many garment-cleaning businesses is the efficient management of floor space. In many instances, it is desirable to more efficiently use floor space in a garment cleaning business for multiple use functions. Thus, it is desirable to have the floor space open under the machine, or to remove machine from the work area when it is not in use. Additionally, it is desirable to provide mechanisms for a garment cleaning business that are more compact to provide more efficient use of limited facility space.

It is therefore an object of the present invention to provide an improved method and apparatus for bagging a garment that may be stored and operated without taking up additional floor space and/or that organizes the bagging apparatus components in a more compact manner.

SUMMARY OF THE INVENTION

The present invention is embodied in a workstation comprising a garment bagging apparatus and suspension members for maintaining the garment bagging apparatus in spaced apart relation to a floor surface.

In another embodiment the invention comprises a garment bagging apparatus having a frame connected to a feeder drive train for supporting a supply of bagging material. A garment support is positioned relative to the feeder drive train. Suspension members attached to the frame suspend the apparatus off of and in spaced apart relation to a floor surface.

In yet another embodiment, a garment bagging apparatus comprises a frame, a feeder drive train for drawing a continuous feed of tubular bagging material from a roll, and a garment support positioned relative to the feeder drive train to receive tubular bagging material over a garment. A feed carriage is included with support members to moveably support the feed carriage solely from a portion of the frame above the feed carriage. Grippers are mounted on the feed carriage to grip the tubular bagging material. When a garment is hung from the garment support, the feed carriage is moveable to positions below the garment.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
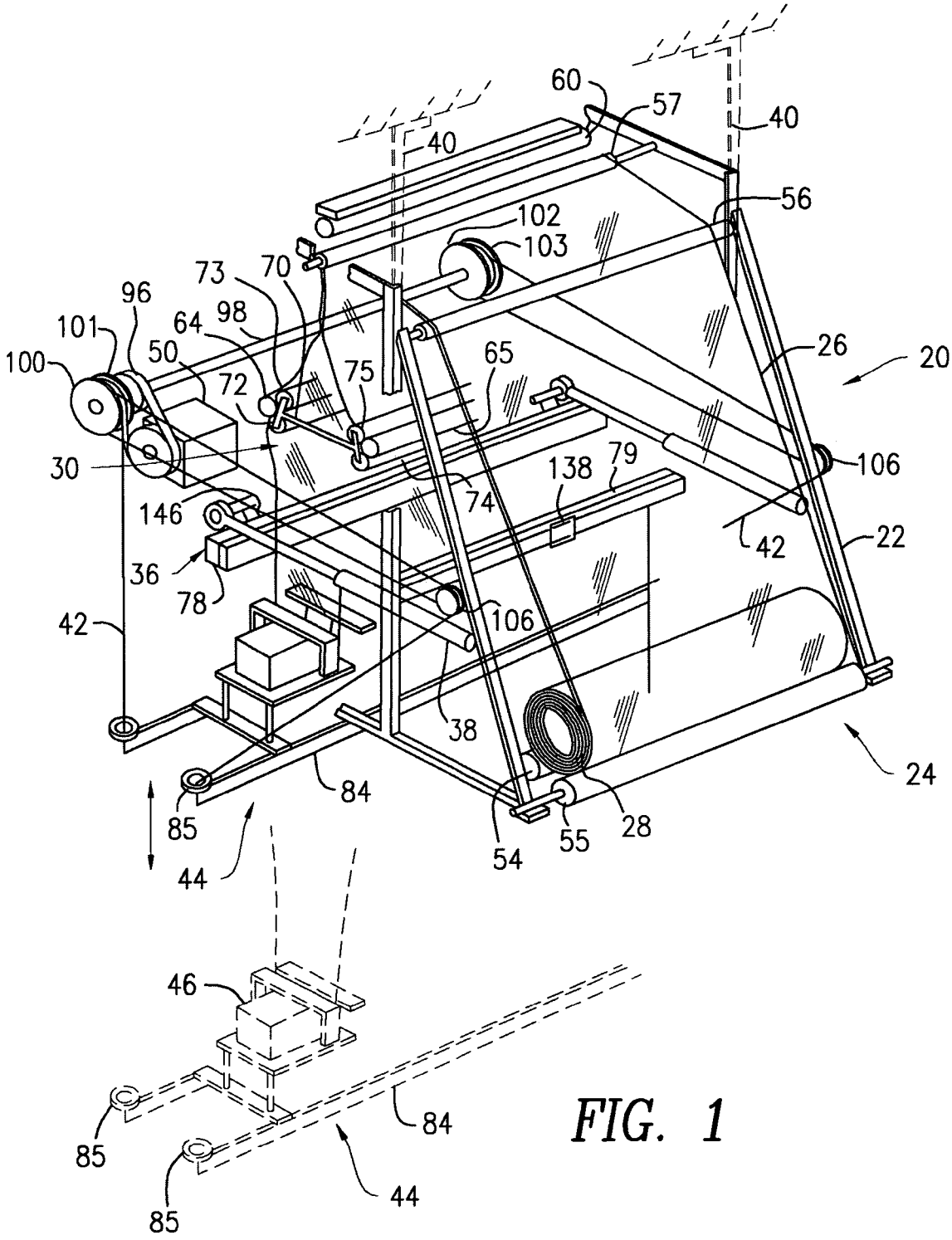
FIG. 1 is a perspective partial view of a garment bagging apparatus of the present invention.
Figure 3:
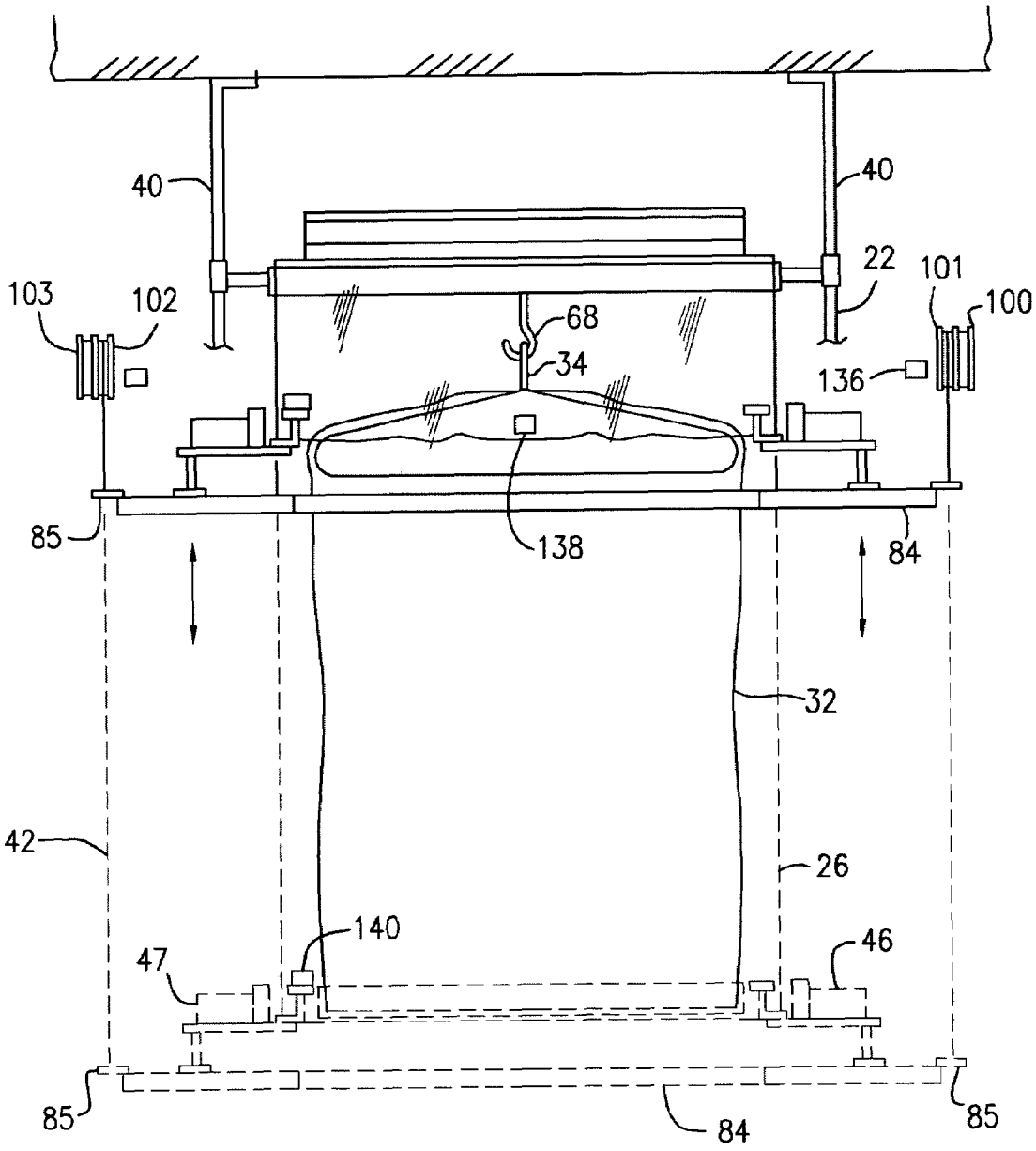
FIG. 3 is a front plan view of the garment bagging apparatus illustrating vertical movement of the feeder mechanism.
Figure 4:
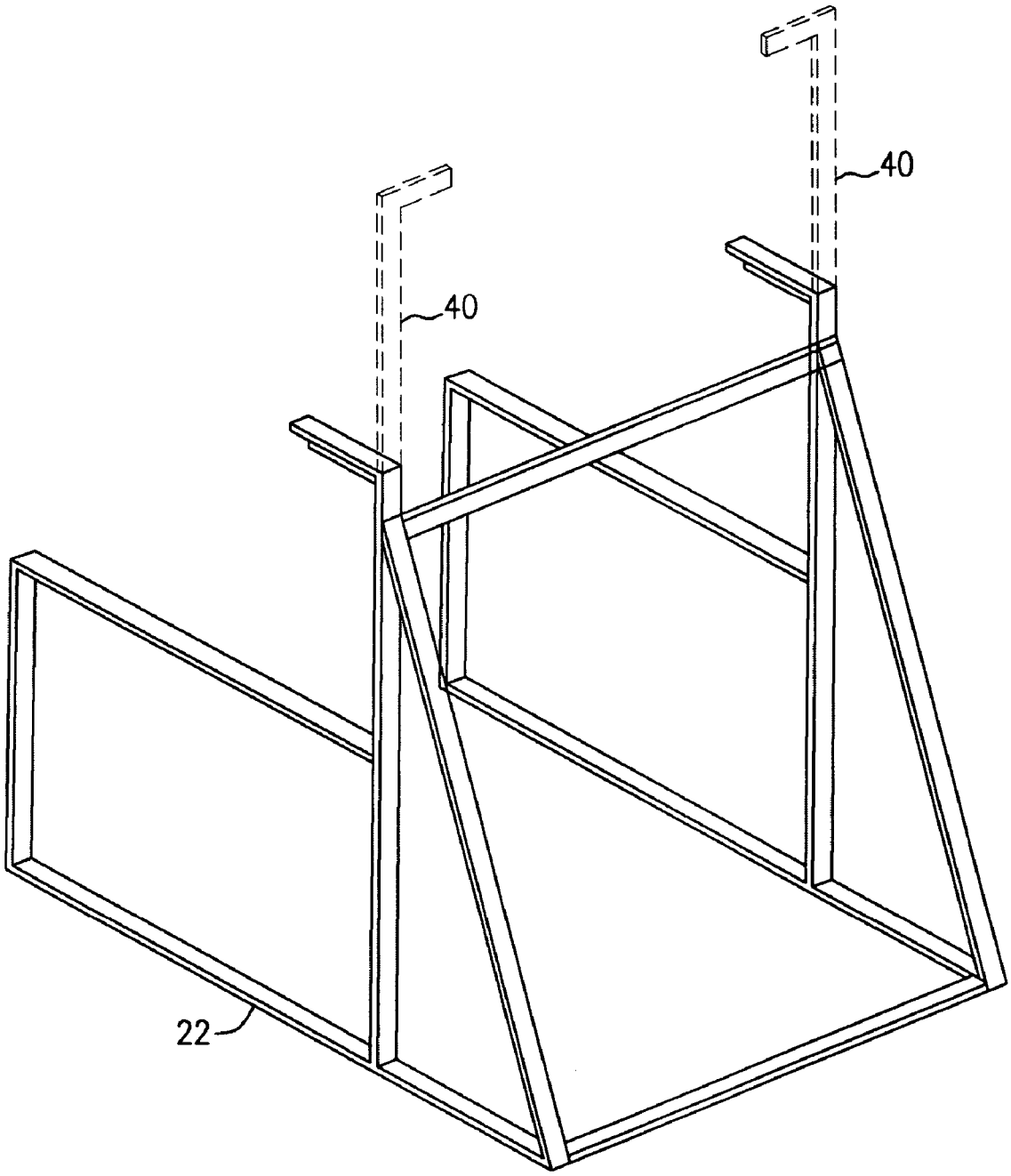
FIG. 4 is a perspective view of frame with suspension members according to the present invention.

With reference to the drawings for purposes of illustration, a garment bagging apparatus 20 according to the present invention generally includes a frame 22 (FIGS. 1 and 4) configured to support a feeder drive train 24 for feeding plastic tubing material 26 from a roll 28. The feeder drive train 24 terminates with a conventional spreader mechanism 29 having a conventional floating hook assembly 30 to support a garment 32 (FIG. 3) suspended by a hanger 34 thereon. A conventional heat sealer and cutter mechanism 36 (FIG. 1) with motor 38 are positioned to seal and cut the plastic material 26 to form a plastic bag from the plastic roll 28 above the garment such that the sealed end of the plastic bag may rest on top of the garment 32. An example of the type of garment bagging apparatus having a configuration of conventional components described thus far is described in U.S. Pat. No. 4,213,284, which is incorporated herein by reference. Advantageously, the present invention further includes frame suspension members 40 that support the frame 22 away from and off of the floor (FIGS. 1 and 4).

Furthermore, in one preferred embodiment, carriage suspension members 42 suspend a plastic material feed carriage 44 with opposing grippers 46-47 from the frame 22. Advantageously, the feed carriage 44 is completely supported and guided from the overlying frame 22 that includes a carriage motor 50 and carriage drive train 52 attached thereto.

Figure 7:
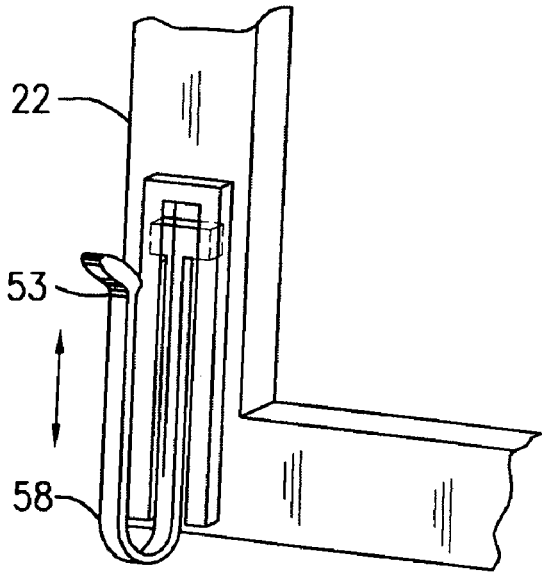
FIGS. 7 and 7*a* is a partial view of a second hook moveable attached to the apparatus frame.
Figure 7A:
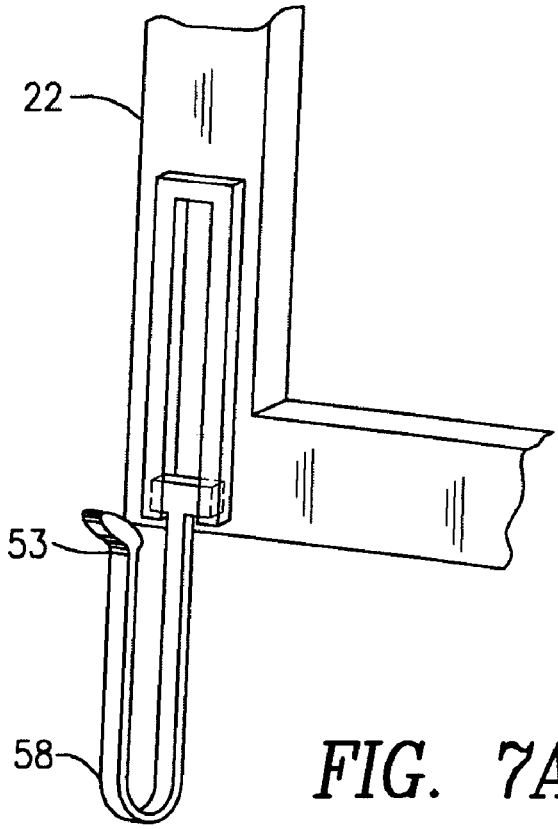

In another variation of a preferred embodiment, a second hook 53 (FIG. 7) is moveably attached to the frame for holding the garment 32 suspended by a hangar 34. The second hook 53 is adapted to permit the placement of a protective paper sleeve over the upper portion of the garment as a preliminary step before bagging of the garment. The hook located near the tip includes a U-shaped arm 58 that is so shaped to allow for passage of the paper sleeve over garment hangar and outward portion of the arm. The second hook maybe attached by any conventional means for moving the hook.

With reference again to FIG. 1, it should be noted that by configuring the garment apparatus feeder drive train 24 and material feed carriage 44 to function in a suspended frame the mechanism eliminates the wasted floor space typically required to support the garment mechanism. Laundry facility wheeled hampers, typically waist high, may be guided or stored under the garment bagging apparatus 20 when the apparatus is not in use. Furthermore, the frame suspension members 40 may be adjustable to move the garment bagging apparatus 20 to an upper storage position. Thereby freeing the work area completely for other uses. As the store hours for collecting laundry often differ from the store hours in which laundry is prepared, moving the garment bagging apparatus out of the way when not in use increases the floor area where racks of finished garments may be stored or to increase the work area for laundry staff. To this end it will be appreciated by those skilled in the art the frame suspension members may include fixed or adjustable members.

Examples of fixed frame suspension members suitable for the present invention may include, but are not limited to, rods or chains suspended from the ceiling or load bearing facility frame members near the ceiling. Additionally, the frame of the garment bagging apparatus may be ganged to the wall by rods secured to the wall. Other forms of fixed suspension members may be understood by those of skill in the art and are further incorporated herein without detracting from the scope of the present invention.

Examples of conventional adjustable frame suspension members suitable for the present invention may include, but are not limited to, chains or ropes attached to a pulley tackle or hoist with a spindle to draw up excess slack that may be automatically or manually used draw-up or release the chain or rope to raise or lower the garment bagging apparatus. Similarly, rods may be conventionally inserted into a track and adjusted in length relative to the floor by a support frame having a pinion gear and a rack formed along a portion of the rods, a drive chain attached to the rods or other similar mechanisms for producing linear motion. It will be appreciated that the support frame may be attached to a wall or affixed overhead to support the garment bagging apparatus. Other forms of adjustable suspension members may be understood by those of skill in the art and are further incorporated herein without detracting from the scope of the present invention.

With continued reference to FIG. 1, the feeder drive train 24 for supplying plastic material 26 from a roll 28 to the garment has been configured to minimize the distance plastic tubing material 26 must travel from the roll 28 to the garment thereby reducing overall surface tension in the plastic material 26 to thereby prevent deformation or tearing in the material. The roll 28 is conveniently positioned away from the bagging work area, but rests upon a pair of rollers 54-55 near the lower end of the frame 22. The rollers 54-55 of the feeder drive train for supporting the roll thereon are positioned near the bottom of the frame to facilitate easy replacement of the roll 28 even when the apparatus 20 is mounted against a wall. An axle may be substituted for the rollers 54-55 in the feeder drive train; however, such a configuration would increase the labor for changing the plastic roll 28 as the axle would need to be removed from the frame and empty roll cylinder, threaded into a new roll and then replaced. The feeder drive train 24 further includes two transfer rollers 56-57 to facilitate transfer of the plastic tubing material 26 from the roll 28 to the spreader mechanism 29 which forms an opening in the plastic tubing material 26 to allow for the plastic tubing material to cover a garment 32. A film hold cylinder 60 is positioned at rest in spaced apart relation to one of the transfer rollers 57, the hold cylinder 60 is operatively attached to a motor 62 (FIG. 5) that is activated with the seal and cut mechanism 36 to press against the transfer roller 57 and hold the tubing material 26 while cutting. The spreader mechanism 29 is configured with two opposing rollers 64-65 with axles affixed to the frame that support a floating hook assembly 30. The hook assembly 30 includes a hook 68 (FIG. 3), for supporting a garment 32, attached below and to a floating carriage 70 with two sets of rollers 72-73 and 74-75 for confronting and rotatably resting upon the opposing rollers 64 and 65 attached to the frame 22 (FIGS. 1 and 4). When a new plastic roll 28 is added to the apparatus 20, the roll slides onto the supporting rollers 54-55 of the feeder drive train 24, plastic tubing material 26 is guided over the feeder drive train transfer rollers 56-57, and the carriage 70 of the spreader mechanism 29 is inserted into an opening at the end of the plastic tubing 26 such that when the carriage rests upon the opposing rollers 64 and 65 the plastic material 26 passes between the carriage 70 and the opposing rollers 64 and 65.

With continued reference to FIG. 1, the heat sealer and cutter mechanism 36 includes opposing arms 78 and 79 that extend beyond the width of the plastic material 26 and are drawn together and separated by a conventional motor with gas or spring loaded props 38.

The feeder carriage 44 (FIGS. 1-3) for drawing down plastic tubing 26 to cover the garment 32 includes a generally C-shaped, rectangular frame 84 for supporting two grippers 46-47. In a preferred embodiment the grippers include solenoid-activated clamps that grip the plastic material at opposing ends of the carriage frame 84. However, those skilled in the art will appreciate that grippers configurations may be applied including, but limited to, vacuum or suction gripping of the plastic. Support members 42 that connect to a carriage motor 50 and carriage drive train 52 support the carriage frame 44 under the garment bagging assembly 20. A conventional motor of the type suitable for this purpose is an AC motor having a disk brake. In the currently preferred embodiment four support members 42 in the form of nylon filaments are used to support the carriage at its four corners 85. The carriage drive train 52 includes a drive belt 96 that connects between the motor 50 and a reel axle 98. Two pairs of reels 100-101 and 102-103 are supported at opposing ends of the reel axle 98. Rearward attaching support members 40 are threaded over opposing spindles 106 attached to the frame 22. The spindles 106 may be attached in a fixed form or may include springs to functions as idlers to dampen vibration in the support members. While the presently preferred embodiment utilizes nylon filaments, such as heavy gauge fishing line, the support members 40 may include any form of retractable supports such as, but not limited to, wire cable, chain and the like. Additionally, although four support members are preferred for nylon filament, three may be sued to maintain the elevation of the feed carriage frame 84. It will be appreciated by those skilled in the art that the carriage drive train and number of support members would need to be adapted accordingly when using different forms of retractable support members.

Figure 2:
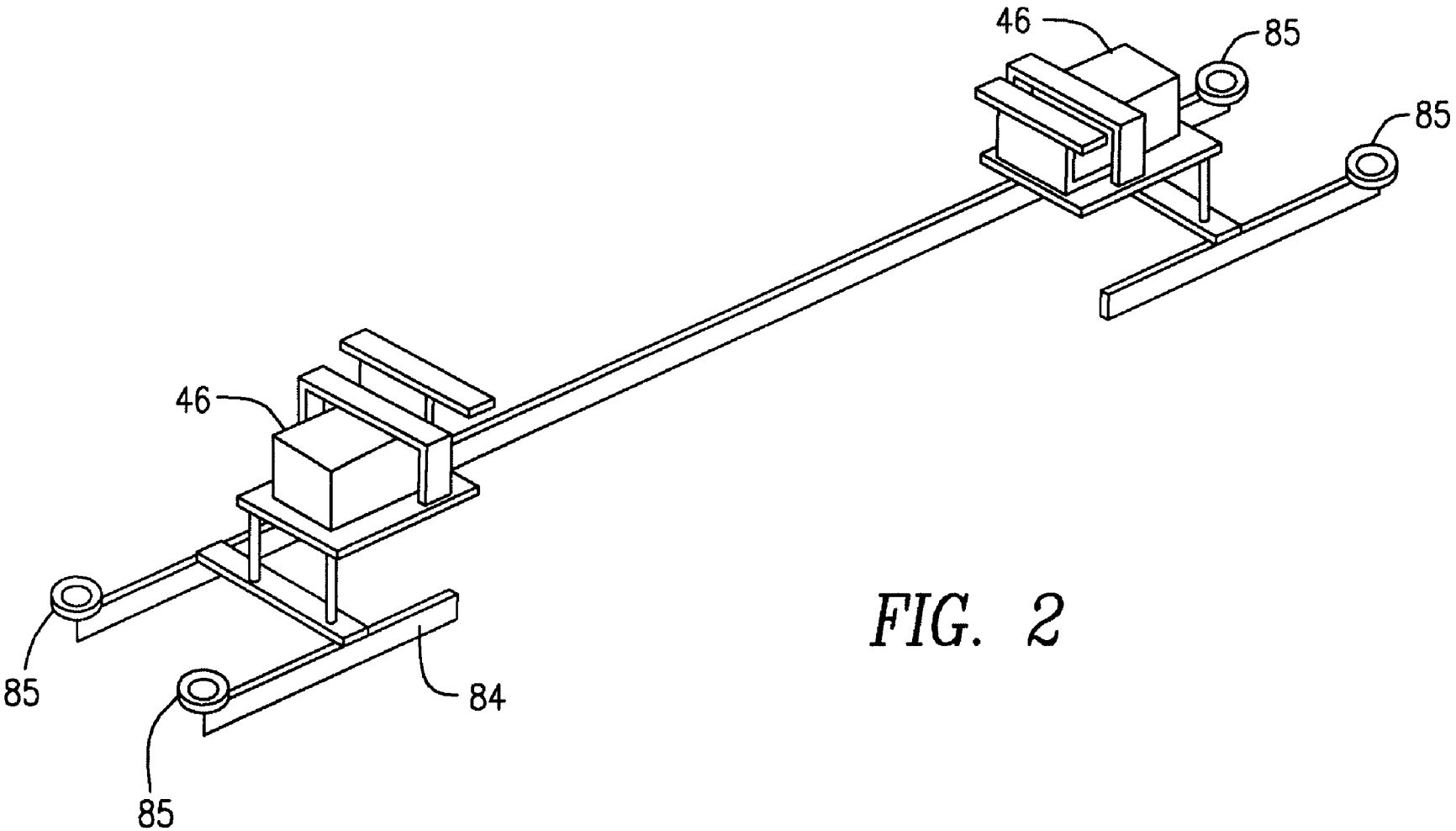
FIG. 2 is a perspective view of a feeder mechanism according to the present invention.

With reference to FIG. 2, the feed carriage 44 is adjusted to retract to an upper height sufficient to allow the end of the plastic tubing material to enter the opening of the grippers 46-47. Upon receiving a signal to engage the plastic material 26, the motor 50 and carriage drive train 52 are switched into a neutral mode that allows the feed carriage 44 to move downward as shown by arrow 107 by gravity. At least one sensor on the carriage is positioned to detect when a garment 32, suspended on a hangar 34, has been attached to the hook 68. The apparatus either responsive to placement of the garment 32 or actuation by an operator, signals the motor 50 and carriage drive train 52 to release the feed carriage 84. The feed carriage 44 and plastic tubing material 26 are drawn downward thereby enclosing the garment 32 with in the plastic tubing material 26. The at least one sensor upon detecting the end of the garment or more appropriately, when detecting the absence of garment material, signals the motor 50 to stop and hold the feed carriage 44 below the garment 32. The sealer and cutter mechanism 36 then seals and cuts the plastic 26 above the garment 32 in a conventional manner. The feed carriage 44 then releases the plastic 26 from the grippers 46-47 and the operator can remove the bagged garment from the apparatus. Upon detecting removal of the garment, the feed carriage 44 then returns to the upper position.

Figure 5:
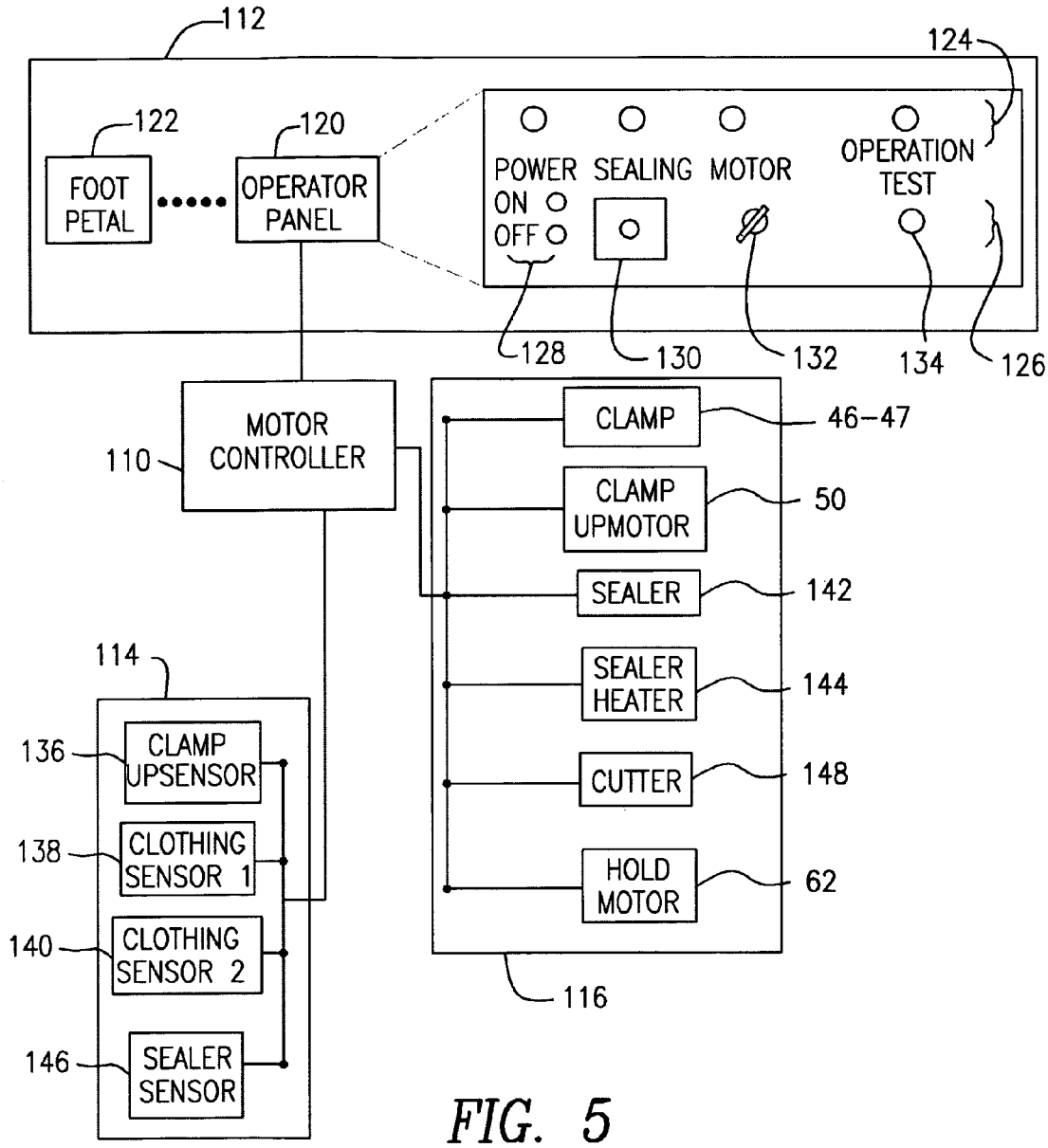
FIG. 5 is a functional block diagram of the electrical control of the garment bagging apparatus.

With reference to FIG. 5, operation of the garment bagging apparatus is provided by an electrical circuit 108 that includes a motor controller 110 operatively connected a user interface 112 and the operational sensors 114 and devices 116.

In one embodiment the motor controller circuitry is a transistorized design type in which logical and sequential activation and deactivation of the various operational devices 116 controlled by the motor controller 110 are triggered in response the user interface 112, sensors 114 and conventional resistor-capacitor based timing circuits. Such configurations are well known to those of ordinary skill in the art.

In an alternate embodiment, the motor controller circuitry includes a central processing unit (CPU) having memory and software to control the operation of various devices 116 controlled by the motor controller 110 in which logical and sequential activation and deactivation of the various devices 116 controlled by the motor controller 110 are determined by software in response to the user interface 112 and sensors 114. Presently a motor controller having a CPU, memory and software is preferred as the software may be adapted to include set-up routines that allow the operator to adjust and select the activation, sequence and timing of the various devices 116. Thus allowing the garment-bagging apparatus to operate more efficiently according the needs of the facility where it is being used. It will be appreciated that those of ordinary skill in the art could prepare a software program for carrying the functions discussed herein.

The user interface 112 may include an operator panel 120 and/or a foot pedal 122 for controlling operation. In the present embodiment, the operator panel 120 includes a display 124 and control keys 126 to ensure proper operation various components. The control keys presently include a power 128, sealing 130 and carriage motor control 132 as well as an operational test mode 134. The operational test mode allows the operator to manually trigger each of the operational devices in order to adjust and/or diagnose the need to adjust timing and engagement of the various operational devices. In general, once the garment bagging apparatus has been powered up, the motor controller 110 operation is triggered automatically by the at least one clothing sensor detecting the presence of a garment. The optional foot pedal 122 or operator control panel 120 may be used to activate the motor controller operation manually such as when a garment is of such a construction that it is not readily detected by the at least one sensor.

In the present embodiment, the motor controller 110 is electrically connected to operational sensors 114 and devices 116 including grippers 46-47, a sensor 136 for detecting when the feed carriage has been fully retracted to it upper position, the feed carriage motor 50. The at least one sensor for detecting the presence of a garment includes a first sensor 138 to detect a garment 32, suspended by a hangar 34, that is placed upon the hook 68. A second sensor 140 is placed along the feed carriage 44 to detect travel to the end of the garment 32. The motor controller 110 further connects to the motor 62 of the hold cylinder 60 (FIG. 1), the motor 142 of the sealer and cutter mechanism, the sealer heater 144, a sealer sensor 146 to detect proper closure of the sealer and cutter mechanism using a proximity sensor along the rod and a cutter 148 to cut the bag above the seal along the width of the bag.

In operation, the motor controller is powered by pressing the power key 128 "on" the operator control panel. At initialization the motor controller 110 can be configured to initialize and began operation with the detection of a garment 32 on the hook 68 by the first clothing sensor 138 or the device may be configured to run a test sequence in operational test mode to ensure all operation devices 116 are functioning adequately. The feed carriage up sensor 136 is then read to ensure that the feed carriage is in an upper position to grip the plastic tubing material 26.

Figure 6:
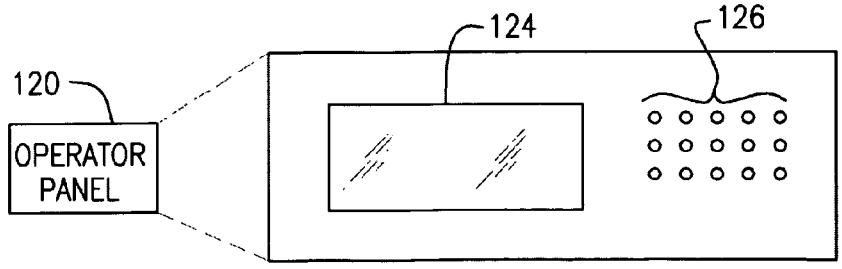
FIG. 6 is a alternate operator panel of FIG. 5.

In an alternate embodiment for the operator panel (FIG. 6) a display 124 using an LCD and keypad 126 for use with a computer-operated apparatus are shown.

Upon detection of a garment 32 (FIG. 3), suspended by a hangar 34, placed on the hook 68 of the apparatus, the grippers 46-47 are activated to grip the plastic tubing material 26. The carriage motor 50 is then deactivated allowing the feed carriage 44 to drop downward by gravity thereby pulling the plastic tubing material 26 over the garment 32. Upon the second clothing sensor 140 detecting the end or absence of the garment 32, the carriage motor 50 is activated to stop movement of the feed carriage 44. The motors for the hold cylinder and the seal and cut mechanism 62 and 142 are activated to draw the hold cylinder 60 against the transfer roller 57 (FIG. 1) and to press the seal and cut mechanism arms 78-79 together with the plastic material 26 in between. The sealer 144 is then activated against the plastic tubing material 26 to heat the material until the heat sensor 146 detects that a threshold temperature has been reached. The sealer 144 is then deactivated and the cutter 148 is activated to cut the plastic tubing material 26 above the portion that has been sealed. The motor for the sealer and cuter mechanism and hold cylinder 142 and 62 are then operated to move them away from the plastic material 26. The portion of the plastic material recently sealed and cut from the roll 28 is moved again by the carriage 44 which is temporarily released and stopped by the motor 50 using a timer to pull the newly formed plastic bag onto the garment 32. The garment still suspended by a hook 68 is then removed from the apparatus. The first clothing sensor 138, upon detecting the absence of the garment, signals the motor controller 110 that in turn activates the feed carriage motor 50 to retract the feed carriage 44 until the upper position is reached and detected by the carriage up sensor 136. The motor controller 110 then resets and awaits placement of another garment 32 on the hook 68. Advantageously all of these operations occur with the apparatus suspended above the floor and with the apparatus started and reset by the operator by merely adding and removing a garment respectively.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A garment bagging apparatus comprising:

a frame;

a feeder drive train mounted on said frame for supporting a supply of bagging material;

a garment support mounted on said frame and positioned relative to said feeder drive train;

suspension members attached to said frame for suspending said apparatus off of and in spaced apart relation to a floor; and a feed carriage assembly mounted to said frame and movable between said frame and the floor and below said frame and garment support for drawing bagging material over a garment hung on said garment support.

2. The apparatus of claim 1 including:

a carriage motor and carriage drive train operatively connected to said carriage motor; and support members connected between said feed carriage and said carriage drive train and responsive to said carriage motor and carriage drive train to move said feed carriage relative to said frame.

3. The apparatus of claim 2 wherein said feed carriage is moveable in at least one direction by gravity.

4. The apparatus of claim 2 wherein said feed carriage includes grippers.

5. The apparatus of claim 1 wherein said garment bagging material is supplied on a roll and said feed drive train includes support rollers.

6. The apparatus of claim 1 wherein the garment bagging material is a roll of tubular material, including:

a spreader mechanism for opening the tubular material delivered from the roll to the garment by the feed drive train;

a sealer and cutter mechanism for sealing and cutting garment bags from the tubular material; and said feed carriage assembly includes a feed carriage movable between said frame and the floor, a carriage motor and carriage drive train operatively connected said carriage motor, and support members connected between said feed carriage and said carriage drive train and responsive to said carriage motor and carriage drive train to move said feed carriage relative to said frame.

* * * * *